US006189779B1

(12) United States Patent
Verdicchio et al.

(10) Patent No.: US 6,189,779 B1
(45) Date of Patent: Feb. 20, 2001

(54) LATCHING MECHANISM

(76) Inventors: Richard Verdicchio, 18 Beck Avenue, Toronto (CA), M4C 4L5; Michael Cranwell, 73 Roncesvalles Avenue, Unit #1, Toronto, Ontario (CA), M6R 2K6

( * ) Notice: Under 35 U.S.C. 154(b), the term of this patent shall be extended for 0 days.

(21) Appl. No.: 09/390,212

(22) Filed: Sep. 8, 1999

(30) Foreign Application Priority Data

Sep. 9, 1998 (CA) ..... 2246873

(51) Int. Cl.[7] ..... B65D 5/20
(52) U.S. Cl. ..... 229/155; 229/148
(58) Field of Search ..... 229/148, 149, 229/150, 155, 194, 195

(56) References Cited

U.S. PATENT DOCUMENTS 1,354,042 * 9/1920 Hunziker ..... 229/148
2,690,286 * 9/1954 Dawson ..... 229/155
3,021,993 * 2/1962 Kennedy et al. ..... 229/149
3,086,691 * 4/1963 Fobiano ..... 229/195
3,403,839 * 10/1968 Farquhar ..... 229/148
3,684,159 * 8/1972 Wolfe ..... 229/148
3,786,983 * 1/1974 Hennessey ..... 229/195
4,063,678 * 12/1977 Hall ..... 229/155
4,948,038 * 8/1990 Moeller ..... 229/149
5,411,204 * 5/1995 DeMay ..... 229/155
5,531,373 * 7/1996 Eisman ..... 229/148

FOREIGN PATENT DOCUMENTS

3935 * 9/1979 (EP) ..... 229/155

* cited by examiner

*Primary Examiner*—Gary E. Elkins

(57) ABSTRACT

A latching mechanism is provided for a container such as a card wallet, folder, small box, small carton, etc. having a closure flap or lid overlying another panel of the container. The container is formed of stiff sheet material such as card stock. Interengaging parts of the latching mechanism are an embossed catch rising from a slit in an under panel and a debossed, stamped out, tongue to engage in the slit in the overlying flap.

11 Claims, 6 Drawing Sheets

FIGURES
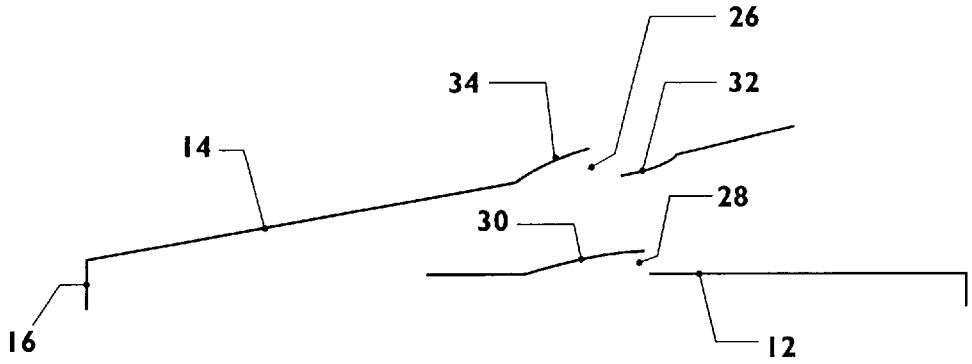
6A
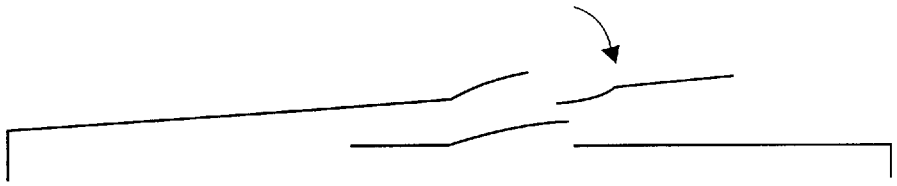
6B
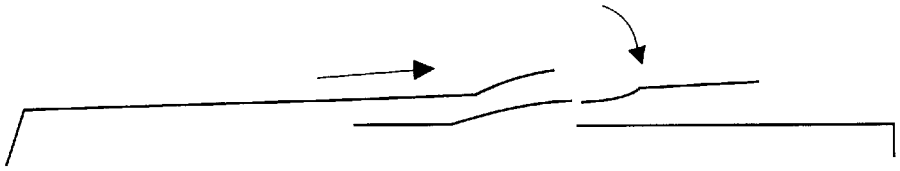
6C
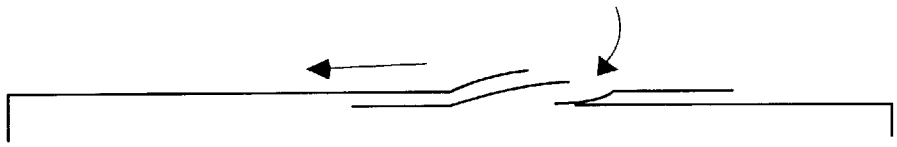
6D

FIGURES
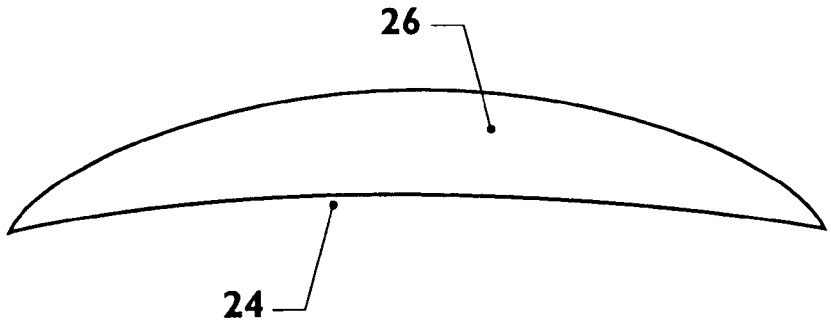
8A
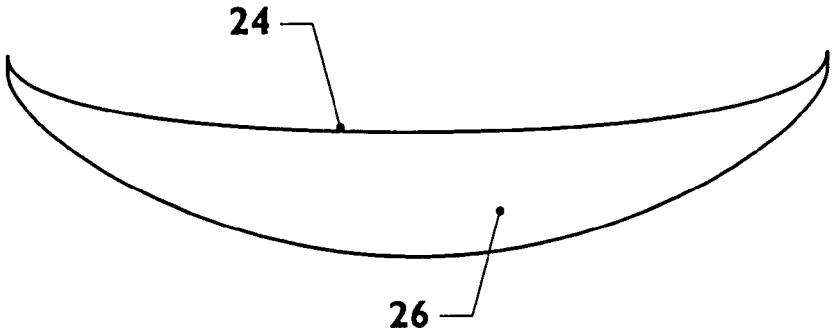
8B
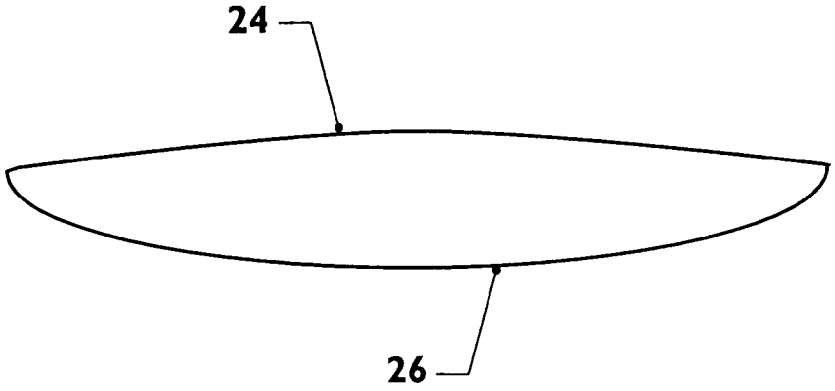
8C

LATCHING MECHANISM

BACKGROUND OF THE INVENTION

1. Field of the Invention

This invention relates to a latch for latching together two overlapping sheets of semi-rigid material. Especially, the invention relates to a latch for articles having overlapping closure flaps, for example, cartons of all shapes and sizes, e.g. packing boxes and card wallets.

2. Acknowledgement of Prior Art

On the one hand, many cartons are formed from carton blanks having complex systems of tabs and slots to hold the cartons in erected condition and to hold any lid in closed position. Such cartons may, for example, be made from paper products such as card stock. On the other hand, wallets and other fold-over containers may be made of leather or simulated leather or plastic materials. Such containers are frequently provided with a mechanical two part latch, one part being on one flap of the container and the other part being on another flap of the container.

Other containers such as pencil cases having a fold over cover flap may have a rearwardly projecting cut-out tongue which may be biassed inwardly of the flap to slip under a catcher band on the body of the pencil case. This construction has some advantages in that material is not wasted in cutting complex tabs to project from the flap and in that the flap itself may be wholly tucked beneath the catcher band if desired. Nevertheless, it may be difficult to provide a biassing reaction in such a case to urge the tongue beneath the catcher band. Moreover, when the case is filled tightly with pencils or other contents the catcher band may become unduly tight making insertion of the tongue beneath it very difficult.

The present inventors have attempted to devise a reliable, simple, latch to hold two overlapping sheets of semi-rigid material in fixed relation one to the other.

SUMMARY OF THE INVENTION

According to the invention there is provided in a container closable through an upper flap overlying a lower flap of semi-rigid sheet material, the flaps being formed of semi-rigid sheet material having a latching mechanism between the upper and lower flaps comprising a projecting catch on the lower flap and an aperture through the upper flap located to engage the flaps in a closed position thereof, the projecting catch being formed by an embossed region of the lower flap extending towards a root of the lower flap from an arcuate slot concave towards the root of the flap; the aperture being shaped as a gibbosity or a segment of a circle.

BRIEF DESCRIPTION OF THE DRAWINGS

An embodiment of the invention will now be described by way of example with reference to the drawings, in which:

FIG. 6A, 6B, 6C and 6D are sections through the flaps of FIGS. 2–5 during the last stages of latching;

FIGS. 8A, 8B and 8C are exemplary aperture parts of the latch mechanism.

DETAILED DESCRIPTION OF A PREFERRED EMBODIMENT

Figure 1:
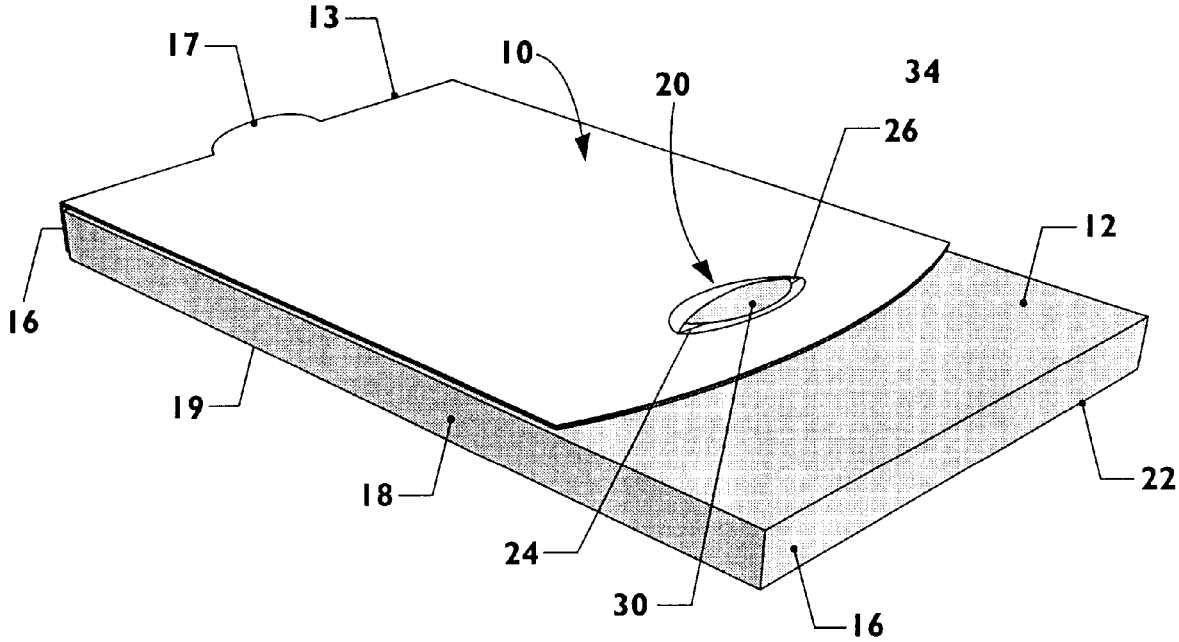
FIG. 1 is a perspective view of a card wallet having a latch mechanism according to the invention.

FIG. 1 shows a container such as a card wallet 10 of folded card construction. The container may alternatively be a folder, small box, small carton, etc. The card wallet 10 is formed from a blank wrapping around a stack of business cards and having a pair of overlapping flaps 12, 14 on a top surface. The blank may be of card or semi-rigid plastics sheet material or other semi-rigid sheet material. End side panels 16 may be included in the wrap around flaps 12, 14. Lateral side panels 18 may be provided by lateral flanges of the carton blank bent upwardly and folded inwardly over the cards. The overlapping flaps 12, 14 are connected to a back panel 19 through the side panels 18.

The overlapping flaps 12, 14 are latchable together through a latch mechanism 20 according to the invention to hold the card wallet 10 closed. The latch mechanism 20 comprises an upstanding catch 30 on the lower flap 12 to engage a leading edge 24 of an aperture 26 in the upper flap 14.

The aperture 26 is shaped as a segment of a circle or as a thin gibbosity. Sample aperture shapes are shown in FIGS. 8A, 8B, and 8C.

The catch 30 is formed by cutting an arcuate slit 28 in flap 12 concave towards the proximal edge of flap 12 such that the slit 28 is directed towards the free end of flap 12 to form a tongue. The tongue is embossed so that it stands proud of flap 14 as catch 30. The root of tongue 30 may be connected to the main body of flap 14 at a stamped coin line 29.

As illustrated the leading edge 24 of aperture 26 is the more slightly curved edge of the gibbosity so that the tip of tongue 30 engages the edge 24 of aperture 26 when the flaps are engaged. It is, however, possible to arrange aperture with its more nearly straight edge 24 as the leading edge so that the curved edge or tip of tongue 30 engages this straight or nearly straight edge of aperture 26.

To make engagement between tongue 30 and the leading edge of aperture 26 as easy as possible, the leading margin 32 of flap 14 immediately adjacent the leading edge 24 of slot 26 may be debossed slightly so that an indentation is presented to tongue 30 as the flaps are engaged. The leading margin 32 of aperture 26 adjacent leading edge 24 may be connected to the main body of flap 12 through a stamped coin line 27.

Additionally, the trailing margin 34 of flap 14 immediately adjacent the trailing edge of aperture 26 may be embossed to conform with the shape of tongue 30 so that a flap 14 can lie generally against flap 12 without being canted up on tongue 30. The trailing margin 34 may be connected to the main body of flap 12 through a stamped coin line 25.

The procedure for engaging flaps 12 and 14 as set out below with reference to FIGS. 2, 3, 4, 5 and 6A–D.

Figure 2:
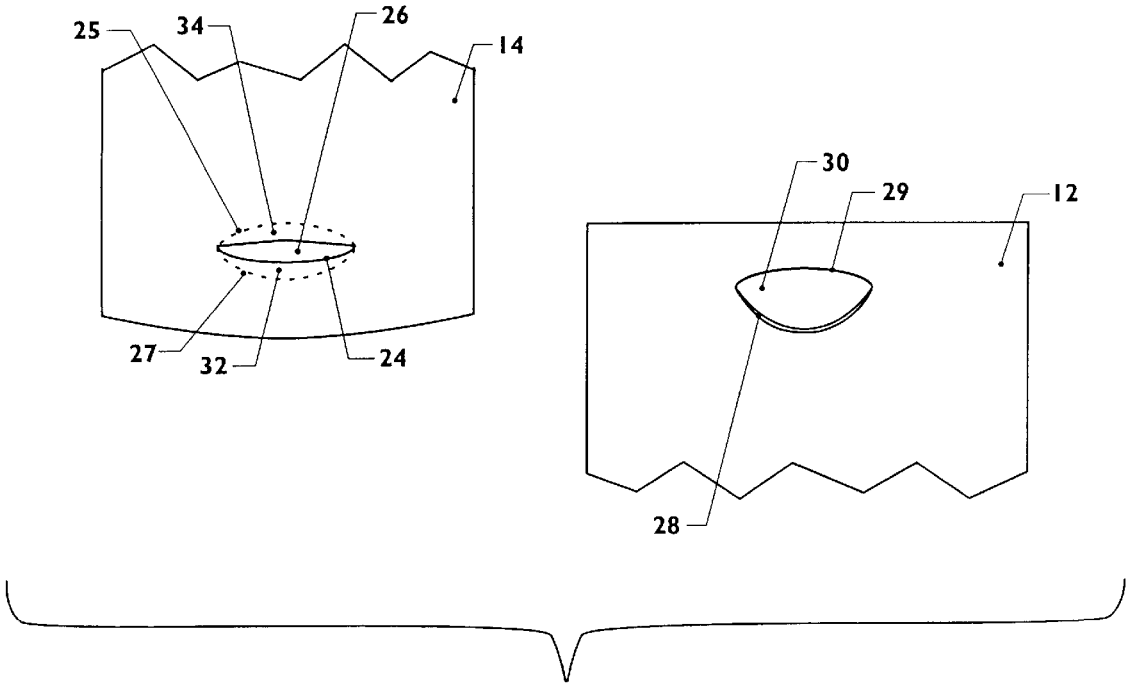
FIG. 2 is a schematic representation of overlying and underlying flaps of the card wallet of FIG. 1 having means to latch them together.
Figure 7:
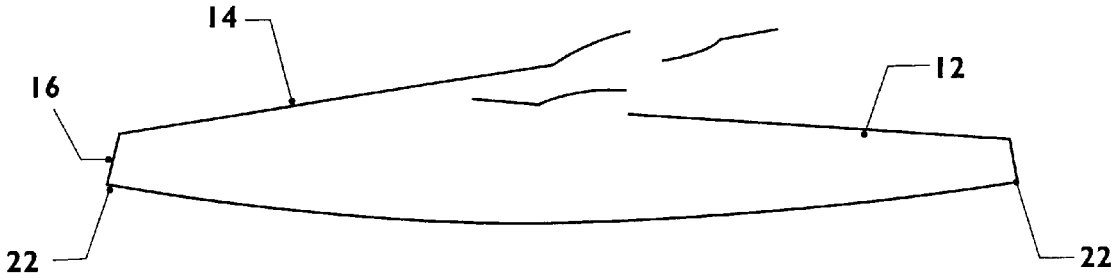
FIG. 7 is a schematic sketch showing distortion of a card wallet as illustrated in FIG. 1 during the latching operation.

FIG. 2 shows flaps 12 and 14 separated one from the other. In fact, in this position flaps 12, 14 will be hinged upwardly from respective side panels 18 but for reasons of simplicity they are shown separated one from the other in FIG. 2. To engage the flaps, the lower flap 12 is folded down at right angles to its side panel 18 to cover or partially cover any cards in card wallet 10. This position may best be seen in the schematic section of FIGS. 6A–6D. Thereafter flap 14 is folded downwardly on top of flap 12. As it is folded downwardly it may be biassed slightly towards the root of flap 12 so that leading edge 24 of aperture 26 clears the tip of tongue 30 as it descends. The bias used may be such as to slightly distort the whole carton or card wallet as shown in FIG. 7 but it may be more usual that the bias is only sufficient to overcome any natural tendency of the side panels 18 to tend to hinge outwardly to open the angle of the fold at opposed base edges 22 of the wallet 10.

Figure 3:
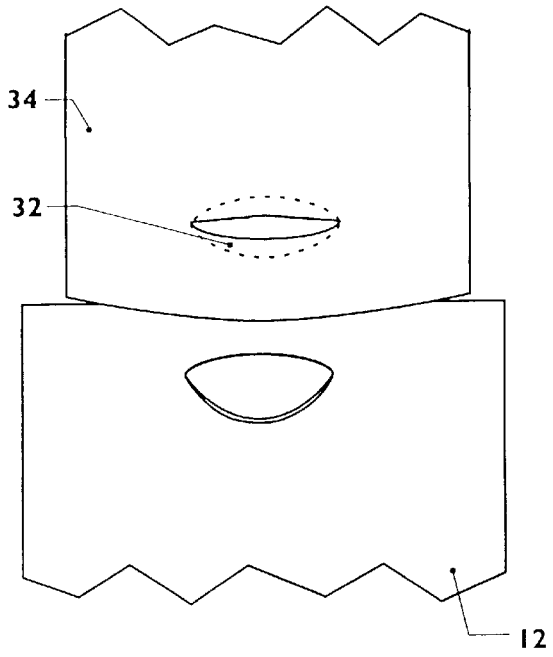
FIG. 3 shows the flaps of FIG. 2 more closely approached to each other in preparation for latching.
Figure 4:
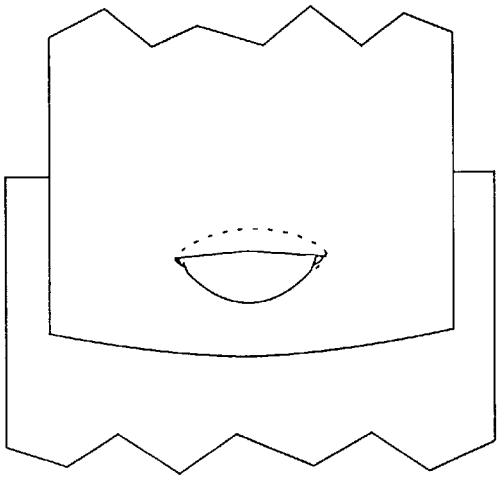
FIG. 4 shows the flaps of FIG. 2 immediately before latching.
Figure 5:
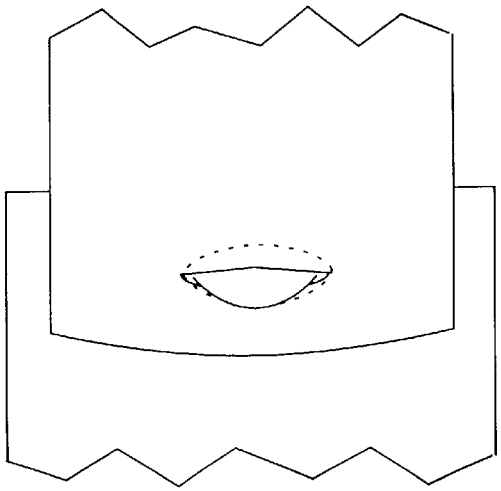
FIG. 5 shows the flaps of FIG. 2 in latched condition.

The flap 14 is shown coming into position for engagement with flap 12 in FIG. 3. FIG. 4 shows the flap 14 located immediately over and above flap 12 ready for engagement. The sequence of events from this point is better seen in FIGS. 6B, 6C and 6D which show the flap 14 descending. FIG. 6B shows the situation where leading edge 24 of aperture 26 has not yet descended past the tip of tongue 30. FIG. 6C shows the situation incrementally later where the leading edge 24 of aperture 26 is just clearing the tip of tongue 30 under exerted bias on flap 14 towards the root of flap 12 in the direction of arrow A. FIG. 6D and FIG. 5 show the situation when leading edge 24 of aperture 26 has cleared the tip of tongue 30 and descended from it. Exerted bias has been removed and natural bias in the direction of arrow B towards the root of flap 14 has been reestablished to bring leading edge 24 of aperture 26 underneath the tip of tongue 30. The embossing of tongue 30 and regions 32 and 34 of flap 14 immediately adjacent to aperture 26 may be seen best in FIGS. 6A–6D.

While the procedure for engaging the flaps has been described with the involvement of manual bias so that leading edge 24 of aperture 26 clears the tip of tongue 30, the use of this bias may not be necessary. If the tip of tongue 30 fouls the leading edge 24, then downward pressure may force the leading edge 24 to snap past the tip of tongue 30. This may be perfectly acceptable when the semi-rigid sheet material is plastic material such as polyethylene, and even for some card materials. However, if the flaps are to be engaged and disengaged frequently, the snapping action may cause wear on the tip of tongue 30 and on the leading edge 24. For this reason it may be desirable to design the card wallet or other carton so that it is possible to utilize manual bias to cause leading edge 24 to clear the tip of tongue 30 properly. This may be done by making the card wallet very slightly longer than the length of cards to be contained in it. In this case side panels 18 may be bent inwardly towards each other to allow leading edge 24 to clear the tip of tongue 30. When manual force is removed the side panels 18 will tend to spring back into position or even beyond.

It is convenient to provide a lever convenient to the thumb of a use to tip the upper flap 12 into position for engagement of leading edge 24 under tongue 30 or to tip the flap away from the tongue. Such a lever may be provided on a side of the card wallet 10. One of the side panels 16 is connected to a proximal side edge of the upper flap 12 through a coined line 13 for folding the panel 12 at right angles to the side panel. The fold line 13 may not be continuous but may be broken by a short section 15 which is not coined. A cut out 17 in side panel 16, which may be generally semi-circular may connect the ends of uncoined section 15. The cut out 17 may then extend from the flap 12 at right angles to the side panel 16 and may be located conveniently for one handed tilting and positioning of flap 12. The extending cut out 17 may also be pushed in the plane of the flap 12 to move it against the bias to disengage leading edge 24 from tongue 30.

Due to the natural tendency of plastic and paper products to attempt to regain their original shape, the latching mechanism described may be useful for many wrap around products. When the carton material is card or paper based, the orientation of the latching mechanism may be such that the paper fibres in flaps 12 and 14 generally lie parallel to each other and act to bias leading edge 24 into engagement under tongue 30. When the article to which the latching mechanism is not formed with wrap around flaps, it may be necessary to provide additional means to bias leading edge 24 into engagement under tongue 30.

What is claimed is:

1. A container closable through an upper flap of stiff sheet material which overlies an under portion of the container; the upper flap latching with the under portion through a latching mechanism;

the latching mechanism comprising:

a projecting catch on the under portion to engage an aperture in the upper flap;

the projecting catch being formed by an embossed tongue of the under portion rising from a root to an upper edge of an arcuate slit in the lower portion concave towards the roof of the embossed tongue;

the aperture having a shape selected from a gibbosity and a segment of a circle, the upper flap being biassed to slide over the under portion to engage a leading edge of the aperture under said upper edge of the arcuate slit, and the upper flap being slidable over the under portion against bias to disengage said leading edge of the aperture under said upper edge of the arcuate slit.

2. A container as claimed in claim 1 in the form of a card wallet, the stiff sheet material being folded to form at least a wallet back panel and a top formed by an upper flap overlying an upper flap, said projecting catch being on the under flap and said aperture being in the upper flap, the position of said projecting catch and the aperture and folds in the stiff sheet material being such as to bias said leading edge of said aperture under said upper edge of said arcuate slit.

3. A container as claimed in claim 2 in which each of the upper flap and the under flap are joined to the back panel through side panels.

4. A container as claimed in claim 2 in which the stiff sheet material is card stock.

5. A container as claimed in claim 2 in which a leading margin of said aperture is debossed to facilitate engagement of said leading edge under said upper edge of said slit.

6. A container as claimed in claim 5 in which said leading margin joins a main body of said upper flap through a stamped coin line.

7. A container as claimed in claim 2 in which a trailing margin of said aperture adjacent a trailing edge is embossed to conform with and to fit above said embossed tongue.

8. A container as claimed in claim 7 in which said trailing margin joins the main body of said upper flap through a stamped coin line.

9. A container as claimed in claim 2 in which said root of said tongue joins a main body of said under flap through a stamped coin line.

10. A container as claimed in claim 2 in which the upper flap joins an adjoining side panel along a proximal edge through a coined fold line to each side of a leverage tongue;

the lever being formed by a short uncoined portion of said proximal edge and a cut out portion of said adjoining side panel, the cut out portion connecting ends of the uncoined portion.

11. A container as claimed in claim 2 in which the aperture is a gibbosity of which the leading edge is less curved than the trailing edge.

* * * * *